US007705242B2

(12) United States Patent
Winterhalter

(10) Patent No.: US 7,705,242 B2
(45) Date of Patent: Apr. 27, 2010

(54) ELECTRICAL CONDUCTOR AND CORE FOR AN ELECTRICAL CONDUCTOR

(75) Inventor: Michael A. Winterhalter, Dana Point, CA (US)

(73) Assignee: Advanced Technology Holdings Ltd., Dana Point, CA (US)

( * ) Notice: Subject to any disclaimer, the term of this patent is extended or adjusted under 35 U.S.C. 154(b) by 329 days.

(21) Appl. No.: 12/070,244

(22) Filed: Feb. 15, 2008

(65) Prior Publication Data

US 2009/0114420 A1 May 7, 2009

Related U.S. Application Data

(60) Provisional application No. 60/901,404, filed on Feb. 15, 2007.

(51) Int. Cl.
*H01B 7/18* (2006.01)

(52) U.S. Cl. ..... 174/102 R; 174/106 R

(58) Field of Classification Search ..... 174/102 R, 174/103, 105 R, 106, 107, 108; 385/101, 385/100, 106, 107, 109, 111, 112, 113
See application file for complete search history.

(56) References Cited

U.S. PATENT DOCUMENTS 3,328,140 A * 6/1967 Warren ..... 428/602
3,482,034 A * 12/1969 Rhoades et al. ..... 174/102 R
3,692,924 A * 9/1972 Nye ..... 174/120 SR
4,344,669 A * 8/1982 Uchida et al. ..... 385/141
5,761,361 A * 6/1998 Pfandl et al. ..... 385/100
6,087,000 A * 7/2000 Girgis et al. ..... 428/392
7,211,319 B2 * 5/2007 Hiel et al ..... 428/300.7
7,368,162 B2 * 5/2008 Hiel et al. ..... 428/300.7
7,586,042 B2 * 9/2009 Varkey et al. ..... 174/102 R
2004/0131834 A1 * 7/2004 Hiel et al. ..... 428/292.1
2004/0182597 A1 * 9/2004 Smith et al. ..... 174/126.1
2006/0289189 A1 * 12/2006 Aisenbrey ..... 174/36

* cited by examiner

*Primary Examiner*—William H Mayo, III
(74) *Attorney, Agent, or Firm*—The Watson IP Group, PLC; Jovan N. Jovanovic; Vladan M. Vasiljevic

(57) ABSTRACT

A core for an electrical conductor. The core includes an inner core component, an intermediate cladding component and an outer cladding component. The inner core component comprises a plurality of glass based stranded members in a first resin matrix. The intermediate cladding component surrounds the inner core component and comprises a plurality of carbon stranded members in a second resin matrix. The outer cladding component surrounds the intermediate cladding component and comprises a plurality of glass based stranded members in a third resin matrix. The first resin matrix and the second resin matrix are substantially independent of each other, meeting at a boundary. An electrical conductor as well as a manufacturing method is likewise disclosed.

33 Claims, 3 Drawing Sheets

ELECTRICAL CONDUCTOR AND CORE FOR AN ELECTRICAL CONDUCTOR

CROSS REFERENCE TO RELATED APPLICATION

This application claims priority from U.S. Provisional Patent Application Ser. No. 60/901,404 filed Feb. 15, 2007, entitled "Electrical Conductor and Core for An Electrical Conductor" the entire specification of which is hereby incorporated by reference.

BACKGROUND OF THE INVENTION

1. Field of the Invention

The invention relates in general to electrical transmission and distribution cables, and more particularly, to an electrical conductor having a core comprising a composite construction.

2. Background Art

The demand for transmission and distribution cables increases with the greater demand for electricity. As the appetite for power increases, new electrical cables continue to be installed. Additionally, to increase capacity, other electrical installations are rewired with cables of greater capacity.

Traditionally, such electrical cables comprise a central stranded steel core which is wrapped in a stranded aluminum conductor. Such cables have been utilized for decades with very little change. Amongst other drawbacks, such cables are susceptible to excessive sag in certain climates and under certain operating conditions. Furthermore, such cables are susceptible to corrosion in other environments.

To combat the shortcomings, other composite based solutions have been developed. Certain such solutions are described in U.S. Pat. No. 7,060,326; U.S. Pub. Nos. 2004-0131834; 2004-0131851; 2005-0227067; 2005-0129942; 2005-0186410; 2006-0051580; U.S. Provisional Patent Application Ser. No. 60/374,879; and PCT Pub. No. WO 03/091008, the entire disclosures of each of the foregoing are incorporated herein by reference in their entirety. Such solutions have replaced the central steel stranded core with a composite material having a core component formed from a carbon fiber material embedded within a matrix and an outer component formed from a fiber material other than carbon embedded within a resin. The core is formed by pultruding the various fibers through pultrusion dies.

Such a fiber likewise has a number of drawbacks. While the composite material is resistant to corrosion, and may be less susceptible to sagging, the fiber construction and the method of manufacturing same leads to non-uniform cores, which may not be of sufficient strength for a particular application. Moreover, the placement of the carbon fiber limits the desirability of such a core.

It is an object of the present invention to provide a core for an electrical conductor which comprises a composite material.

It is another object of the present invention to provide an electrical conductor having a composite core.

It is yet another object of the present invention to provide a method of manufacturing process to form a composite core for use in association of an electrical conductor.

These objects as well as other objects of the present invention will become apparent in light of the present specification, claims, and drawings.

SUMMARY OF THE INVENTION

In one aspect of the invention, the invention comprises a core for an electrical conductor. The core includes an inner core component, an intermediate cladding component and an outer cladding component. The inner core component comprises a plurality of glass based stranded members in a first resin matrix. The intermediate cladding component surrounds the inner core component and comprises a plurality of carbon stranded members in a second resin matrix. The outer cladding component surrounds the intermediate cladding component and comprises a plurality of glass based stranded members in a third resin matrix. The first resin matrix and the second resin matrix are substantially independent of each other, meeting at a boundary.

In one embodiment, the first resin matrix and the second resin matrix comprise different materials.

In another preferred embodiment, the inner core component comprises a plurality of substantially boron free E-glass stranded members, or S-glass. In one such embodiment, the inner core component predominantly comprises a plurality of substantially boron free E-glass stranded members.

In another preferred embodiment, the outer cladding component comprises a plurality of substantially boron free E-glass stranded members or S-glass. In one such embodiment, the outer cladding component predominantly comprises a plurality of substantially boron free E-glass stranded members or S-glass members.

Preferably, the core includes a protective coating extending around the outer cladding component.

In another preferred embodiment, each of the intermediate cladding and the outer cladding include a cross-sectional area. The cross-sectional area of the intermediate cladding component is substantially identical to the cross-sectional are of the outer cladding component.

In another preferred embodiment, the first matrix comprises a UV cured resin. Additionally, the second matrix and the third matrix each comprise a non-UV cured resin.

In yet another preferred embodiment, the inner core includes at least one of E-glass, D-Glass, E-CR glass, S-glass, R-glass, RH-glass, S2-glass. In another such embodiment, the inner core is substantially free of carbon fiber strands.

Preferably, at least one of the intermediate cladding and the outer cladding is helically wound at an angle of between 1° and 40°.

In another embodiment, the intermediate cladding comprises a plurality of radially outward layers.

In another aspect of the invention, an electrical conductor can be wrapped about the outer cladding. In one embodiment, the electrical conductor comprises a plurality of strands which extend around the outer cladding component.

In yet another aspect of the invention, the invention comprises a method of forming a core for an electrical conductor. The method comprises the steps of (a) forming an inner core component from a plurality of first fiber strands embedded within a first resin matrix; (b) at least partially curing the resin matrix of the inner core component; (c) forming an intermediate cladding component having a plurality of second fiber strands embedded within a second resin matrix about the inner core component; (d) forming an outer cladding component having a plurality of third fiber strands embedded within a third resin matrix about the intermediate cladding component; and (e) curing resin matrix of each of the intermediate cladding component and the outer cladding component.

In a preferred embodiment, the step of at least partially curing the inner core component further comprises the step of fully curing the inner core component.

In another preferred embodiment, the step of at least partially curing the inner core component comprises the step of UV curing.

Preferably, the steps of forming an intermediate cladding and of forming an outer cladding component occur substantially simultaneously.

In a preferred embodiment, the method further comprises the step of coating the outer cladding component.

In another preferred embodiment, at least one of the two steps of forming further comprises the step of helically winding the fiber strands of a respective intermediate cladding component and the outer cladding component.

BRIEF DESCRIPTION OF THE DRAWINGS

The invention will now be described with reference to the drawings wherein.

DETAILED DESCRIPTION OF THE INVENTION

Figure 1:
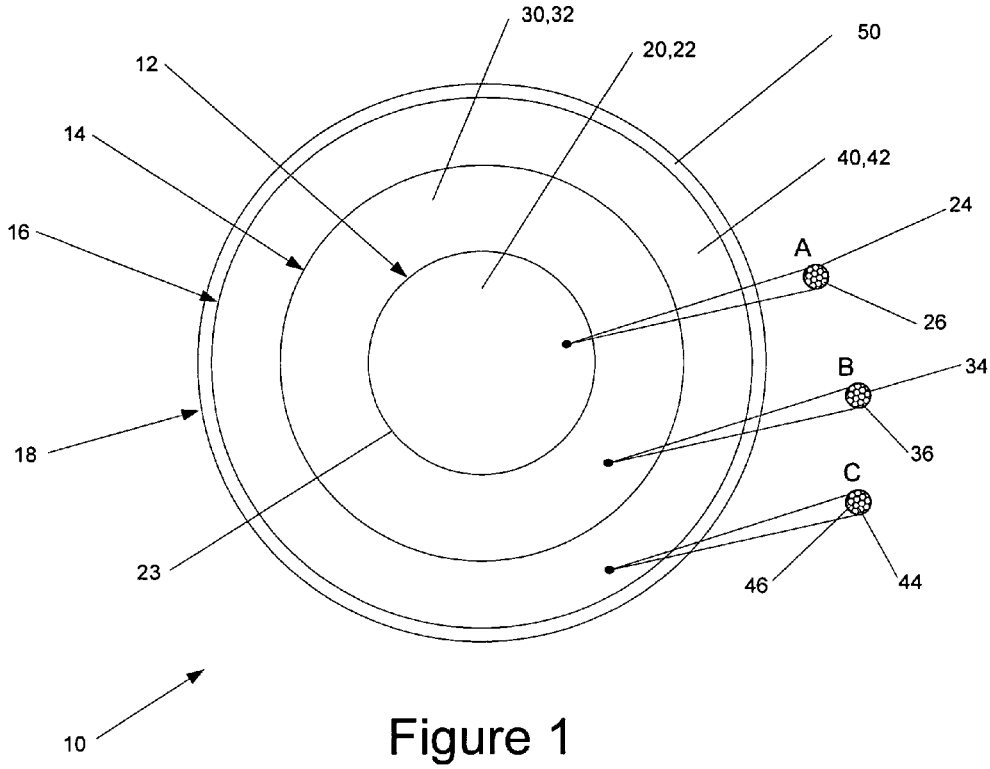
FIG. 1 of the drawings is a cross-sectional view of the core of the present invention, showing, in particular three enlarged portions thereof, namely enlargements A, B and C.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 3:
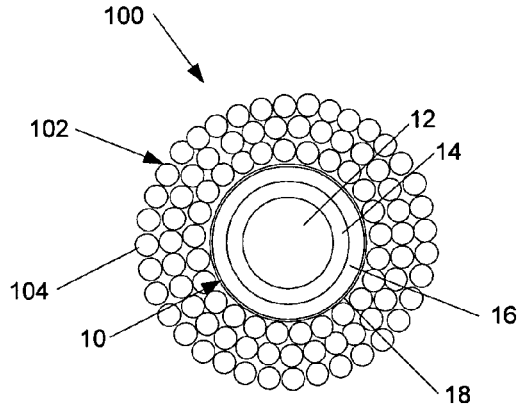
FIG. 3 of the drawings is a cross-sectional view of an electrical conductor having a core of the present invention.
Figure 4:
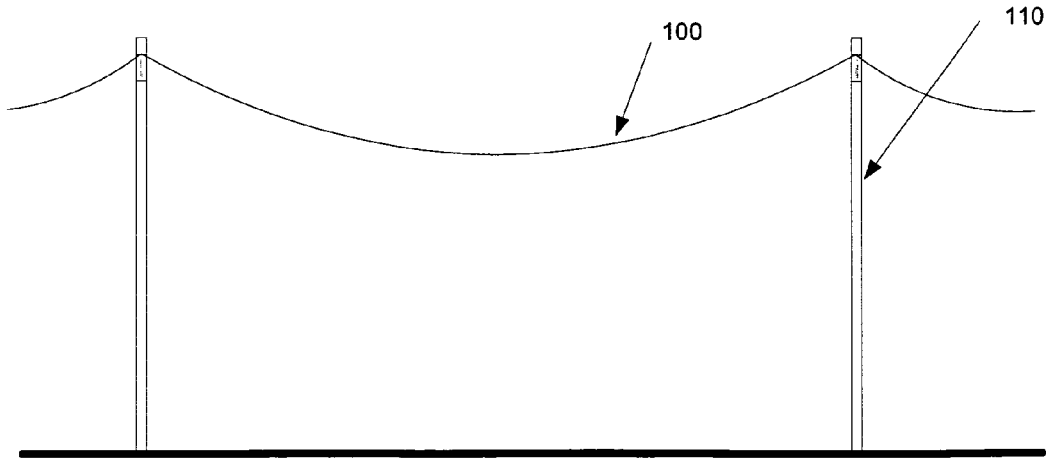
FIG. 4 of the drawings is a side elevational view of the electrical conductor extending between exemplary towers or poles.

Referring now to the drawings and in particular to FIG. 3, an electrical conductor is shown at 100. The electrical conductor of the type associated with the present invention is typically referred to as stranded overhead transmission and distribution conductor. Typically, such conductors are used to transmit and distribute high voltage power forming the backbone of the national grid, for example. With reference to FIG. 4, the electrical conductor is typically strung between electrical poles and towers 110 of varying sizes. The system operating voltages of such electrical conductors typically ranges from 2,400 V to 765,000 V, although not limited thereto.

Electrical conductor 100 includes core 10 and a surrounding electrical conductor 102. Core 10 is shown in greater detail in FIG. 1 as comprising inner core component 12, intermediate cladding component 14, outer cladding component 16 and protective coating 18. The core, when formed comprises a flexible and bendable member which, while resilient, can be wound about a conventional drum for shipment and installation.

The overall electrical conductor is available in a number of different sizes, so as to be configured to carry a number of different and varying loads. Commonly, the overhead conductors have the following common names attributed to sizes, namely, Linnet, Hawk, Dove, Grosbeak, Drake, Cardinal, Bittern, Lapwing, Chukar and Bluebird. At low temperatures, these differently sized conductors carry between 500 Amps (75° C.) and in excess of 3200 Amps (180+° C.). The core diameters of the various sizes range between approximately 0.2" and approximately 0.5".

Inner core component 12 includes a plurality of stranded member 24 embedded in a resin matrix 26. The inner core component defines a diameter 20 which is typically of a substantially uniform circular configuration. The particular diameter of the inner core component varies depending on the classification of the cable and the rated capacity of the cable. It is contemplated for the smaller sizes, namely linnet, hawk and dove, the diameter of the inner core may be between 0.03125" and 0.9375", by example. For the larger sizes, namely, drake and larger, the inner core may be larger than 0.9375," such as, for example, 0.1875" or larger. The foregoing examples are identified for exemplary purposes only, and not intended to be limiting.

The stranded members 24 extend substantially in parallel and longitudinally along the length of the core. Preferably, the individual stranded members comprise an E-glass material which is void of any boron content. Advantageously, boron free E-glass is particularly useful as it resists stress corrosion and brittle fracture when exposed to electrical discharge in the presence of water while under a tensile load condition. Preferably, such fibers have a diameter of approximately 13 microns +/−1 micron, although not limited thereto. In such an embodiment, the fibers are referred to as 410 TEX and they are approximately 1200 yards per pound. Typically, the core has a glass to resin ration of approximately 80:20+/−2. The tensile strength of such fibers is approximately between 500 and 550 ksi. In other embodiments, the inner core may comprise any one or more of E-glass, D-Glass, E-CR glass, S-glass, R-glass, RH-glass, S2-glass, among others. Additionally, it is contemplated that some carbon fibers may be inserted herein, although predominantly, the inner core is substantially free of carbon fibers in a most preferred embodiment.

The first matrix 26 may comprise any number of different resins which are compatible with the stranded members 24. For example, the matrix 26 may comprise polyester, vinyl ester, epoxy, epoxy/acrylate, phenolic, urethane, thermoplastics, among others. As the core composite has a Glass Transition Temperature (Tg) of between 190 and 210° C., generally the matrix must be suitable for prolonged exposure close to if not exceeding this temperature. In the embodiment contemplated, the matrix resin comprises a high temperature epoxy anhydride having a maximum Tg of approximately 226° C.

As will be explained below with respect to the manufacturing method, it is highly preferred that the inner core component is cured prior to pultrusion of the intermediate cladding component and the outer cladding component. This insures that the intermediate and outer layers will be suitably centered and that sag during curing can be precluded. Furthermore, separate curing of the inner core prior to the application of an outer core greatly facilitates the proper curing of the entirety of the core. Still further, the separate curing of the different components allows for the use of different resin systems, such that the resin can be tailored to the particular fibers associate therewith and so that the different resins can be utilized in different locations within the composite core. Additionally, the separate curing of the inner core facilitates the centering of the intermediate cladding component.

Intermediate cladding component 14 is shown in FIG. 1 as comprising cross-sectional configuration 30, radial thickness 32, intermediate stranded members 34 and resin matrix 36. The intermediate component substantially uniformly surrounds the outer perimeter of the inner core component. The intermediate cladding component and the inner core component cooperate to define interface 23. The cross-sectional configuration of the intermediate cladding comprises a substantially ring-like structure which includes a substantially uniform radial thickness 32. It is contemplated that the radial thickness may be, for example, between 0.0625" and 0.375" depending on the particular size of the overall electrical conductor. The intermediate cladding component comprises a fiber having a diameter of approximately between 6.9 and 7.2 microns, in the preferred embodiment. Preferably, the ratio of fiber to the resin matrix is approximately 80:20+/−2.

The intermediate stranded members 34 extend substantially in parallel and longitudinally along the length of the core. Preferably, the individual stranded members comprise a carbon fiber material. Advantageously, the carbon fiber material has a coefficient of thermal expansion (CTE) which is close to 0 or even less. Such carbon fibers have tensile strength of between, for example 363 and 700 ksi. Second resin matrix 36 comprises a material which is selected from a set of materials similar to that of the resin matrix 26 of the inner core component.

Figure 5:
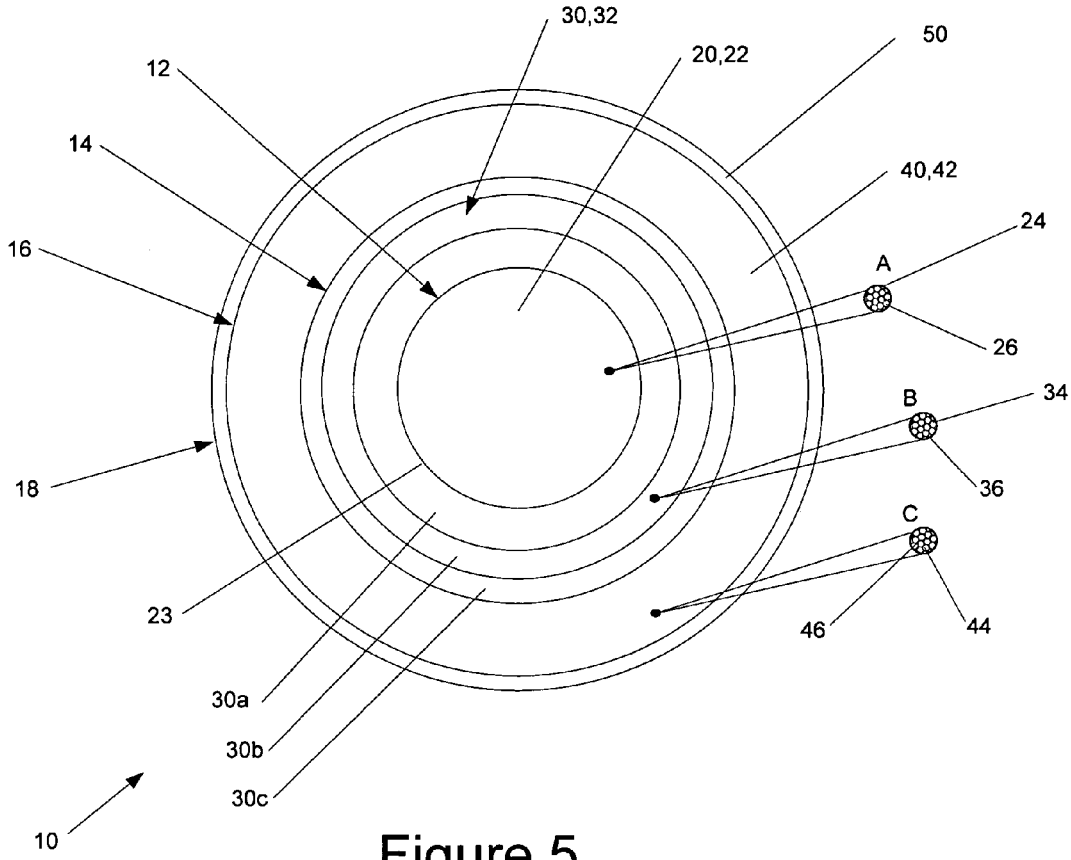
FIG. 5 of the drawings is a cross-sectional view of an alternate embodiment of the core of the present invention.

It is contemplated that the intermediate core comprises a substantially uniform material, namely carbon fiber. However, it is likewise contemplated that a plurality of layers or configurations may be included in the intermediate core. For example, a plurality of rings or layers 30*a*, 30*b*, 30*c* (FIG. 5) can be formed, each of which includes different materials, i.e., different carbon fiber constituents, or carbon fiber constituents interspersed with non-carbon fiber based strands (i.e., glass, etc.).

The outer cladding component layer comprises a cross-sectional configuration 40, a radial thickness 42, a plurality of stranded members 44 and a resin matrix 46. As with the central core component, the outer cladding component preferably comprises a boron-free E-glass fiber or S-2 glass which is embedded in resin matrix 46. In addition to the benefits of boron-free E-glass fiber set forth above, the material further serves to prevent galvanic corrosion between the carbon and the layer of overlapping aluminum on the surface that conducts the electricity. Of course, other materials may be utilized such as the materials identified for use in association with the inner core layer, including but not limited to any one or more of E-glass, D-Glass, E-CR glass, S-glass, R-glass, RH-glass, S2-glass, among others.

The third resin matrix 46 is the same or similar to second resin matrix 36 and, in some embodiments to first resin matrix 26. In the preferred embodiment, the resin matrix 36 and the third resin matrix 46 comprise the same material as the two components are formed simultaneously (i.e., they are a singular material). In certain embodiments, the first resin matrix is different than the second and third resin matrixes. In other embodiments, the resin is uniform throughout.

The outer cladding has a substantially uniform radial thickness 42 and a substantially ring-like cross-sectional configuration. Preferably, the cross-sectional area of the intermediate cladding component and the outer cladding component are substantially identical so as to reduce bowing and similar conditions during the manufacturing process due to uneven distribution of reinforcements, and in turn, the radial thicknesses will be related to each other such that the cross-sectional areas are substantially identical. Of course, it is contemplated that the cross-sectional areas may be varied. In one embodiment, the fiber comprises a 250 yard per pound yield (although higher yields are contemplated). Additionally, the fiber to resin matrix, in a preferred embodiment is approximately 80:20+/−2.

Figure 6:
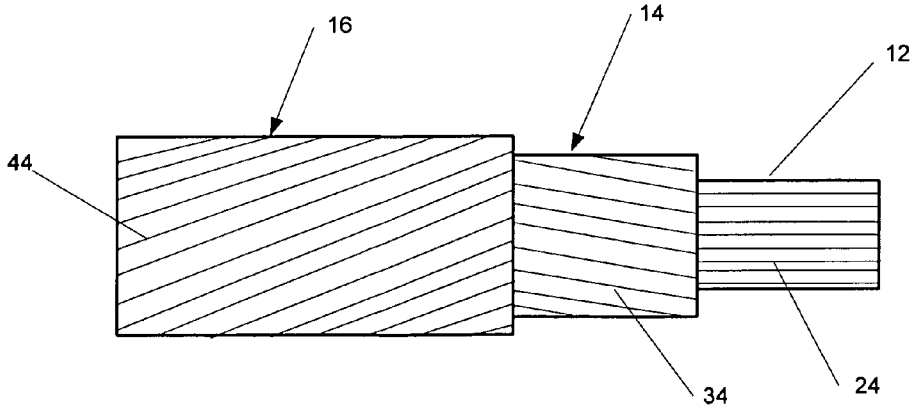
FIG. 6 of the drawings is a top plan view of an embodiment of the core of the present invention, showing, in part, helical windings of the intermediate cladding and the outer cladding, in opposing directions.

In certain embodiments, such as the embodiment shown in FIG. 6, each of the core, the intermediate cladding and the outer cladding may be helically wound about the central axis of the resulting core. For example, the outer cladding (or a portion thereof) may be helically wound about the core at between 1° and 40°, and more preferably between 1° and 7°. Similarly the intermediate cladding (or a portion thereof) can be helically wound (in either the same or an opposing direction, as is shown in FIG. 6). While in the embodiment shown, the core is not helically wound, it will be understood that the core, or a portion thereof, can be helically wound at substantially the same angles.

The protective coating surrounds the outer cladding component and has a radial thickness 50. The protective coating provides UV protection as well as precluding surface resin erosion and the potential for surface electrical tracking. Among other materials, the surface coating may comprise organic surfacing veils such as NEXUS or Reemay (polyethylene terephthalate) based fibers, paints, polymer coatings, such as surface acrylic based coatings, such as HETROLAC. In certain embodiments, such as the embodiment of FIG. 6, the protective coating can be omitted, and instead, the outer cladding will comprise the outermost coating.

With reference to FIG. 3, electrical conductor member 102 may comprise a plurality of strands 104 which are typically formed from an aluminum material (or an alloy thereof, such as annealed 1350 aluminum alloy or the like). Generally, the plurality of strands have a circular cross-section and are wound about the core 10. In other embodiments, the electrical conductor may comprise a configuration wherein the strands are, for example, trapezoidal so as to matingly engage about the core 10. One example of such a electrical conductor is shown in the above-incorporated applications, and the specific conductor configurations are hereby incorporated in their entirety. It will be understood to one of ordinary skill in the art that the invention is not limited to any particular configuration of the electrical conductor member, or any particular dimension or strand quantity thereof. Furthermore, it will be understood that the invention is not limited to the use of any particular conductor material.

To manufacture a electrical conductor 100 of the present invention, the inner core component is first formed. The inner core may be formed by a pultrusion or UV cured process wherein the individual stranded members 24 are embedded in resin matrix 26 (i.e., a resin bath, etc.), and, subsequently pulled through a die or bushing so as to compress the fibers together and so as to dimensionally define the fiber (not shown). The die likewise eliminates excess resin which is present prior to the pultrusion die.

Figure 2:
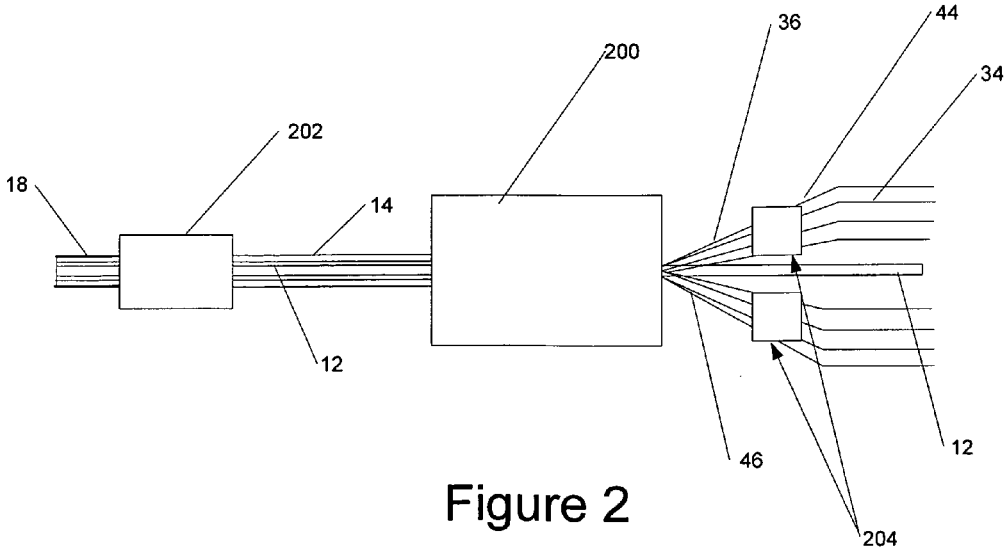
FIG. 2 of the drawings is a schematic representation of an exemplary embodiment of a method of manufacturing the core of the present invention.

With reference to FIG. 2, once pulled the inner core component 12 is then cured to form an inner core rod member. In one embodiment, it is contemplated that the inner core component can be fully cured and wound upon a drum. It can then be unwound to apply the intermediate cladding. In one such embodiment, the inner core component can be UV cured. In another configuration, the inner core can be pulltruded and heat cured/IR cured.

Once fully formed and at least predominantly cured, the intermediate cladding and the outer cladding is then positioned upon the inner core component. More specifically, the inner core component 24 is extended through a second die 200 and leveled. Next, the resin matrix 36, 46 is applied to each of the intermediate stranded members 34 and the outer stranded members 44 at station 204. Once the resin matrix has been applied, the intermediate cladding is directed to the outer surface of the inner core component and the outer cladding is directed to the outer surface of the intermediate cladding. These components are pulled through the second die or bushing 200, wherein the excess resin matrix is removed and the wherein the intermediate and outer components are spatially positioned. Finally, the resin matrix is cured.

This process of forming and preferably, predominantly curing the central core component separate from the application and curing of the intermediate component and the outer component is referred to as a "lost mandrel" approach that provides enhancements to the resulting fiber and enhancements to the manufacture thereof over and beyond the formation of other types of composite electrical core components. In particular, typical processes immerse all of the stranded members in a resin bath, and then they are all pulled through a die to simultaneously spatially form and dimension the core. Such a formation leads to variations along the length of the resulting core and, in turn, non-uniform properties to the resulting core.

To the contrary, the dimensionally cured inner core component provides as a centering core which facilitates the uniform application of the intermediate component and the outer component. Specifically, as the core is dimensionally cured, and leveled, bowing of the resulting pultrusion is substantially eliminated and the pulling process can be substantially uniform about the core. As such, the resulting core is substantially uniform and variations along the length of the produced core can be minimized. Furthermore, by forming the core first, the carbon to glass ratio can be more closely monitored and can be selected with greater precision. Furthermore, the matrix 26 is separate and distinct from the matrix 36 which is typically combined with the matrix 46, and a boundary exists therebetween. Even where the first matrix 26 is not fully cured prior to the addition of the intermediate core and matrix 36, the two matrixes are substantially separated from each other and meet at a boundary. Moreover, by moving the carbon fiber predominantly outside of the inner core, the effectiveness of the carbon fiber can be greatly enhanced.

Once the inner, intermediate and outer claddings are at least partially cured so that the resulting core is substantially dimensionally stable, the protective coating 50 can be applied thereto at 202. Specifically, the protective coating can be applied in any number of different manners, such as spraying, sleeving, painting, squeeging, depositing, applying a synthetic veil in line, among other methods. As set forth above, the coating prevents resin erosion and electrical tracking and provides protection, such as UV protection, to the core components.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A core for an electrical conductor comprising:

an inner core component comprising a plurality of glass based stranded members in a first resin matrix;

an intermediate cladding component surrounding the inner core component and comprising a plurality of carbon stranded members in a second resin matrix; and an outer cladding component surrounding the intermediate cladding component and comprising a plurality of glass based stranded members in a third resin matrix, wherein the first resin matrix and the second resin matrix are substantially independent of each other and meet at a boundary.

2. The core of claim 1 wherein the first resin matrix and the second resin matrix comprise different materials.

3. The core of claim 1 wherein the inner core component comprises a plurality of substantially boron free E-glass stranded members.

4. The core of claim 3 wherein the inner core component predominantly comprises a plurality of substantially boron free E-glass stranded members.

5. The core of claim 1 wherein the outer cladding component comprises a plurality of substantially boron free E-glass stranded members.

6. The core of claim 5 wherein the outer cladding component predominantly comprises a plurality of substantially boron free E-glass stranded members.

7. The core of claim 1 further comprising a protective coating extending around the outer cladding component.

8. The core of claim 1 wherein each of the intermediate cladding and the outer cladding include a cross-sectional area, and wherein the cross-sectional area of the intermediate cladding component is substantially identical to the cross-sectional are of the outer cladding component.

9. The core of claim 1 wherein the first matrix comprises a UV cured resin, and, wherein the second matrix and the third matrix each comprise a non-UV cured resin.

10. The core of claim 1 wherein the inner core includes at least one of E-glass, D-Glass, E-CR glass, S-glass, R-glass, RH-glass, S2-glass.

11. The core of claim 1 wherein the inner core is substantially free of carbon fiber strands.

12. The core of claim 1 wherein at least one of the intermediate cladding and the outer cladding is helically wound at an angle of between 1° and 40°.

13. The core of claim 1 wherein the intermediate cladding comprises a plurality of radially outward layers.

14. An electrical conductor comprising a core surrounded by an electrical conductor, the core further comprising:

an inner core component comprising a plurality of glass based stranded members in a first resin matrix;

an intermediate cladding component surrounding the inner core component and comprising a plurality of carbon stranded members in a second resin matrix; and an outer cladding component surrounding the intermediate cladding component and comprising a plurality of glass based stranded members in a third resin matrix, wherein the first resin matrix and the second resin matrix are substantially independent of each other and meet at a boundary.

15. The electrical conductor of claim 12 wherein the electrical conductor comprises a plurality of strands which extend around the outer cladding component.

16. The core of claim 14 wherein the first resin matrix and the second resin matrix comprise different materials.

17. The core of claim 14 wherein the inner core component comprises a plurality of substantially boron free E-glass stranded members.

18. The core of claim 17 wherein the inner core component predominantly comprises a plurality of substantially boron free E-glass stranded members.

19. The core of claim 14 wherein the outer cladding component comprises a plurality of substantially boron free E-glass stranded members.

20. The core of claim 19 wherein the outer cladding component predominantly comprises a plurality of substantially stranded members selected from the group consisting of: E-glass, D-Glass, E-CR glass, S-glass, R-glass, RH-glass, and S2-glass.

21. The core of claim 14 further comprising a protective coating extending around the outer cladding component.

22. The core of claim 14 wherein each of the intermediate cladding and the outer cladding include a cross-sectional area, and wherein the cross-sectional area of the intermediate cladding component is substantially identical to the cross-sectional are of the outer cladding component.

23. The core of claim 14 wherein the first matrix comprises a UV cured resin, and, wherein the second matrix and the third matrix each comprise a non-UV cured resin.

24. The core of claim 14 wherein the inner core includes at least one of E-glass, D-Glass, E-CR glass, S-glass, R-glass, RH-glass, S2-glass.

25. The core of claim 14 wherein the inner core is substantially free of carbon fiber strands.

26. The core of claim 14 wherein at least one of the intermediate cladding and the outer cladding is helically wound at an angle of between 1° and 40°.

27. The core of claim 14 wherein the intermediate cladding comprises a plurality of radially outward layers.

28. A method of forming a core for an electrical conductor comprising the steps of:

forming an inner core component from a plurality of first fiber strands embedded within a first resin matrix;

at least partially curing the resin matrix of the inner core component;

forming an intermediate cladding component having a plurality of second fiber strands embedded within a second resin matrix about the inner core component;

forming an outer cladding component having a plurality of third fiber strands embedded within a third resin matrix about the intermediate cladding component; and curing resin matrix of each of the intermediate cladding component and the outer cladding component.

29. The method of claim 28 wherein the step of at least partially curing the inner core component further comprises the step of fully curing the inner core component.

30. The method of claim 28 wherein the step of at least partially curing the inner core component comprises the step of UV curing.

31. The method of claim 28 wherein the steps of forming an intermediate cladding and of forming an outer cladding component occur substantially simultaneously.

32. The method of claim 28 further comprising the step of coating the outer cladding component.

33. The method of claim 28 wherein at least one of the two steps of forming further comprises the step of helically winding the fiber strands of a respective intermediate cladding component and the outer cladding component.

* * * * *